US006620004B1

(12) United States Patent
Piper

(10) Patent No.: US 6,620,004 B1
(45) Date of Patent: Sep. 16, 2003

(54) MARINE PROPULSION SYSTEM

(76) Inventor: Jack N. Piper, 103 Collins Ave. #2, Pleasantville, NJ (US) 08232

( * ) Notice: Subject to any disclaimer, the term of this patent is extended or adjusted under 35 U.S.C. 154(b) by 0 days.

(21) Appl. No.: 10/162,053

(22) Filed: Jun. 4, 2002

(51) Int. Cl.[7] ..... B63H 11/14
(52) U.S. Cl. ..... 440/45; 60/211
(58) Field of Search ..... 440/45; 60/211

(56) References Cited

U.S. PATENT DOCUMENTS 3,134,353 A * 5/1964 Pedersen et al. ..... 114/20.1
3,402,555 A 9/1968 Piper
3,779,200 A 12/1973 Hull
4,148,185 A 4/1979 Somers
4,332,219 A 6/1982 Gonzalez
4,450,060 A 5/1984 Gonzalez
5,222,361 A 6/1993 Nelson et al.
5,313,797 A 5/1994 Bidwell
5,989,082 A 11/1999 Corliss
6,484,491 B1 * 11/2002 Thordarson ..... 60/211

* cited by examiner

*Primary Examiner*—Jesus D. Sotelo
(74) *Attorney, Agent, or Firm*—Norman E. Lehrer

(57) ABSTRACT

A marine propulsion system is disclosed that includes at least one nozzle having a combustion chamber therein. The nozzle has an exit end that is shaped so as to flare outwardly. A fuel reformer separates gasoline or other liquid hydrocarbon fuel into hydrogen gas and carbon monoxide and a fuel line feeds the hydrogen gas into the combustion chamber of the nozzle. Combustion air is also fed into the combustion chamber. In addition, measured quantities of raw sea water are also delivered into the combustion chamber. An electrical igniter within the combustion chamber ignites the hydrogen gas causing the water to flash into steam. The steam exhausts through the exit end of the nozzle resulting in a forward thrust.

4 Claims, 1 Drawing Sheet

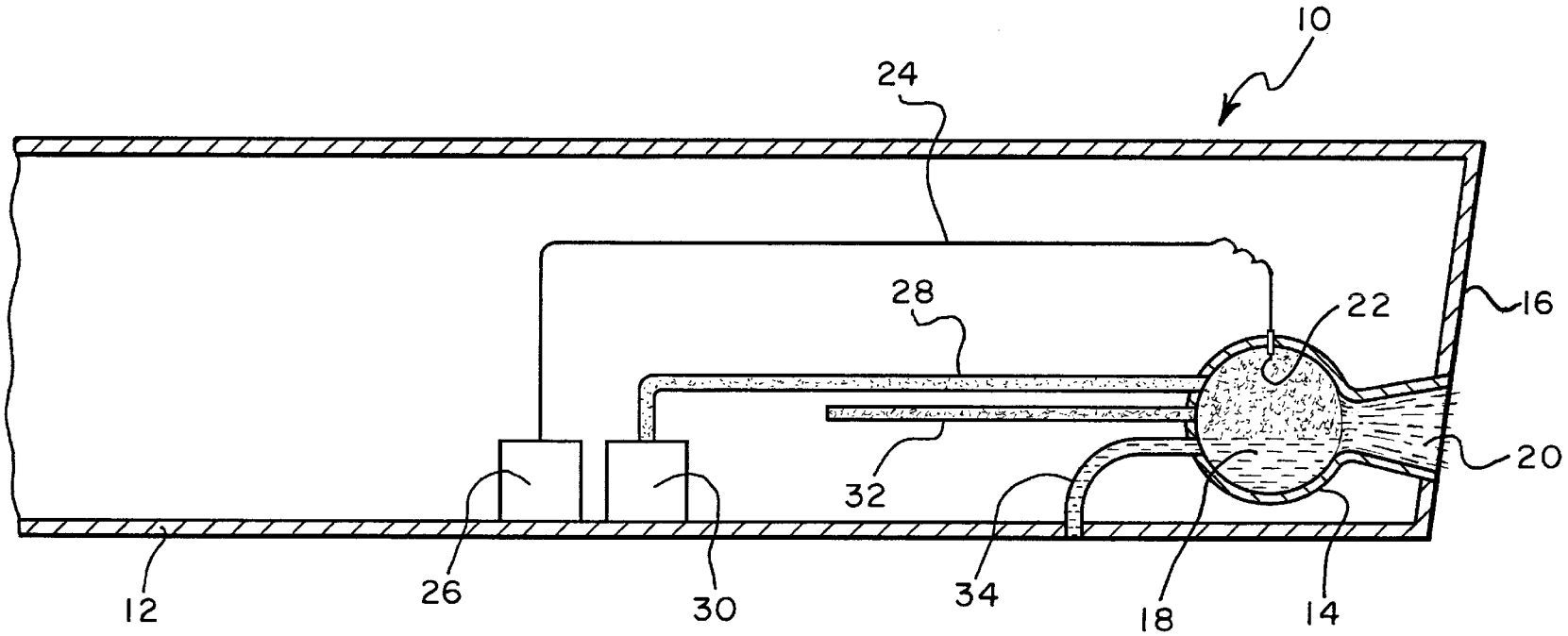
10
16
20
22
14
18
24
28
32
34
30
26
12

MARINE PROPULSION SYSTEM

BACKGROUND OF THE INVENTION

The present invention is directed toward a marine propulsion system and more particularly toward a marine propulsion system that ignites hydrogen gas in the combustion chambers of one or more nozzles to flash raw sea water into steam in order to create forward propulsion. The system can be used by itself or as an enhancement to a more conventional propulsion system such as an internal combustion engine or the like.

This new invention is essentially an improvement on the invention described in my prior U.S. Pat. No. 3,402,555 entitled Steam-Jet Nozzle for Propelling Marine Vessels that issued on Sep. 24, 1968, the entire contents of which are incorporated herein by reference. In my prior patent I describe a system that injects superheated water under pressure into a plurality of nozzles. The sudden release of pressure causes the water instantly to flash or be converted to steam which then expands and exhausts through the open flared exit ends of the nozzles thereby providing forward thrust.

Additional thrust is provided in my prior system by introducing small amounts of raw sea water into the nozzles to be mixed with the live steam. Some or all of this sea water will be heated by the exhausting superheated steam and will also flash into steam thereby creating more pressure and consequently more velocity and density of the exiting fluids.

While my prior system was an improvement on contemporary forms of marine propulsion, it did have some drawbacks. The prior patented system required a steam generating source such as a gas or oil fired burner or a nuclear reactor which obviously added considerable weight and/or expense to the system. In addition, since the water to be converted into steam must be heated and maintained under pressure, a relatively heavy walled tank and heavy duty supply lines and valves and the like were required. All of this added significant further weight and expense to the system. There was also the continuing risk of explosion in view of the elevated pressures that were involved.

A need exists, therefore, for a marine propulsion system that has the benefits of my prior propulsion system but without the several disadvantages discussed above.

SUMMARY OF THE INVENTION

The present invention is designed to overcome the deficiencies of the prior art described above. It is an object of the present invention to provide a marine propulsion system which is simple and light weight.

It is another object of the present invention to provide a marine propulsion system that utilizes the thrust created by water flashing into steam but that does not require a main steam generating source.

It is yet another object of the present invention to provide a novel marine propulsion system that utilizes the thrust created by raw sea water flashing into steam and which can be used as a main source of propulsion or as an enhancement to pre-existing and more conventional propulsion system such as an internal combustion engine or the like.

In accordance with the illustrative embodiments demonstrating features and advantages of the present invention, these and other objects are accomplished through the use of a marine propulsion system that includes at least one nozzle having a combustion chamber therein. The nozzle has an exit end that is shaped so as to flare outwardly. A fuel reformer separates gasoline or other liquid hydrocarbon fuel into hydrogen gas and carbon monoxide and a fuel line feeds the hydrogen gas into the combustion chamber of the nozzle. Combustion air is also fed into the combustion chamber. In addition, measured quantities of raw sea water are also delivered into the combustion chamber. An electrical igniter within the combustion chamber ignites the hydrogen gas causing the water to flash into steam. The steam exhausts through the exit end of the nozzle resulting in a forward thrust.

Other objects, features, and advantages of the invention will be readily apparent from the following detailed description of the preferred embodiments thereof taken in conjunction with the drawing.

BRIEF DESCRIPTION OF THE DRAWING

For the purpose of illustrating the invention, there is shown in the accompanying drawing one form which is presently preferred; it being understood that the invention is not intended to be limited to the precise arrangements and instrumentalities shown.

The sole FIGURE is a schematic representation of a marine propulsion system illustrating the construction and operation of the invention.

DETAILED DESCRIPTION OF THE PREFERRED EMBODIMENTS

Referring now to the drawing in detail, there is shown in the sole figure a marine propulsion system constructed in accordance with the principles of the present invention and designated generally as 10.

The marine propulsion system 10 of the present invention is carried by a boat or ship 12 and includes at least one nozzle 14 mounted adjacent the stern 16 of the boat 12. The nozzle 14 includes a combustion chamber 18 and an exit or exhaust end 20 that faces rearwardly and that is shaped so as to flare outwardly. Located within the combustion chamber 18 is and electric igniter 22 that is electrically connected by conductor 24 to a source of electrical power 26. Power source 26 may be a marine generator, a battery, a solar cell, a thermal electric module or substantially any other type of device capable of delivering electrical power. Although the marine propulsion system 10 of the present invention may be used alone to power a ship, if it is used to supplement a primary conventional main engine, the thermal electric module may be heated by the main engine exhaust.

Hydrogen gas is delivered to the combustion chamber 22 of the nozzle 14 through fuel line 28. Appropriate valving or the like may be provided to control the flow of the hydrogen gas. Furthermore, if necessary, a pump may be used to help deliver the hydrogen gas to the combustion chamber.

The hydrogen gas is produced or supplied by the fuel reformer 30. Such devices are, per se, well known in the art. Fuel reformers provide hydrogen gas by separating a liquid hydrocarbon fuel such as gasoline or the like into hydrogen gas and carbon monoxide. However, other means of supplying hydrogen gas such as an electrolyzer may be used instead of the reformer 30. If an electrolizer is used, it may be powered by the electrical power source 26.

In order to enable combustion of the hydrogen gas within the chamber 18 of the nozzle 14, oxygen is supplied thereto through line 32. Preferably, the oxygen is supplied simply by pumping or injecting air into the combustion chamber. Raw sea water is also supplied to the combustion chamber 18 through line 34. A pump may be provided to pump the sea water to the nozzle or the water could simply be drawn therein through Venturi forces. As pointed out above, appropriate valves and the like may be provided for controlling the flow of the hydrogen gas, the air and the water into the combustion chamber. Furthermore, the entire operation may be computer controlled.

The marine propulsion system described above operates as follows. Hydrogen gas, combustion air and raw sea water are all delivered to the combustion chamber 18 of the nozzle 14 through lines 28, 32 and 34 respectively. The hydrogen gas is then ignited by the igniter 22. This causes the water to flash into steam. The steam exhausts through the exit end 20 of the nozzle 14 resulting in a forward thrust. While this process has been described with reference to only one nozzle 14, it should be readily apparent that the identical process can be applied to a plurality of nozzles that can be operated in unison or sequentially.

The present invention may be embodied in other specific forms without departing from the spirit or essential attributes thereof and accordingly, reference should be made to the appended claims rather than to the foregoing specification as indicating the scope of the invention.

I claim:

1. A marine propulsion system comprising:

a nozzle having a combustion chamber, said nozzle further having an exit end shaped so as to flare outwardly;

a supply of hydrogen gas and means for delivering a quantity of said hydrogen gas to said combustion chamber;

means for delivering a quantity of sea water to said combustion chamber;

means for supplying oxygen to said combustion chamber, and electrical ignition means within said combustion chamber for igniting said hydrogen gas causing said water to flash into steam, whereby said steam exhausts through said exit end of said nozzle resulting in a forward thrust.

2. The marine propulsion system as claimed in claim 1 further including a fuel reformer for providing said supply of hydrogen gas.

3. The marine propulsion system as claimed in claim 2 wherein said fuel reformer provides hydrogen gas by separating a liquid hydrocarbon fuel into hydrogen gas and carbon monoxide.

4. The marine propulsion system as claimed in claim 1 further including an electrical generating means for powering said electrical ignition means.

* * * * *